US010343882B2

(12) United States Patent
Sakatani et al.

(10) Patent No.: US 10,343,882 B2
(45) Date of Patent: Jul. 9, 2019

(54) LOADING DEVICE OF FORKLIFT TRUCK

(71) Applicant: KABUSHIKI KAISHA TOYOTA JIDOSHOKKI, Kariya-shi, Aichi-ken (JP)

(72) Inventors: Isamu Sakatani, Aichi-ken (JP); Takashi Maruyama, Aichi-ken (JP); Daiki Ishida, Aichi-ken (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 478 days.

(21) Appl. No.: 15/067,367

(22) Filed: Mar. 11, 2016

(65) Prior Publication Data

US 2016/0272475 A1 Sep. 22, 2016

(30) Foreign Application Priority Data

Mar. 17, 2015 (JP) ..... 2015-053686

(51) Int. Cl.
*B66F 9/08* (2006.01)

(52) U.S. Cl.
CPC ..... *B66F 9/082* (2013.01); *B66F 9/08* (2013.01)

(58) Field of Classification Search
CPC ..... B66F 9/08; B66F 9/082
See application file for complete search history.

(56) References Cited

U.S. PATENT DOCUMENTS 3,312,361 A * 4/1967 Foster ..... B66F 9/065 414/698
3,883,021 A * 5/1975 Wilhelm ..... B66F 9/0755 116/304
5,131,801 A * 7/1992 Melanson ..... B66F 9/082 33/366.26
5,697,755 A * 12/1997 McCauley ..... B66F 9/082 116/303

(Continued)

FOREIGN PATENT DOCUMENTS

JP 2000-255996 A 9/2000
JP 2009-73618 A 4/2009

OTHER PUBLICATIONS

Communication dated Mar. 20, 2018 from the Japanese Patent Office in counterpart Application No. 2015-053686.

*Primary Examiner* — Saul Rodriguez
*Assistant Examiner* — Ashley K Romano
(74) *Attorney, Agent, or Firm* — Sughrue Mion, PLLC

(57) ABSTRACT

A loading device of a forklift truck includes outer masts provided at a truck body, mast support shafts rotatably supported by the truck body, and weld portions. Each weld portion is formed by weld bead. Each mast support shaft includes a shaft body that is rotatably supported by the truck body, a first flange portion extending forward and upward from the shaft body, and a second flange portion extending forward and upward from the shaft body. An outer periphery of the first flange portion is formed of a first curved surface. An outer periphery of the second flange portion formed of a second curved surface. Each weld portion includes a first weld portion formed along the first curved surface of the first flange portion of the mast support shaft and a second weld portion formed along the second curved surface of the second flange portion of the mast support shaft.

6 Claims, 10 Drawing Sheets

(56) References Cited

U.S. PATENT DOCUMENTS

| | | | | |
|---|---|---|---|---|
| 5,758,747 | A * | 6/1998 | Okazaki | B66F 9/08 187/227 |
| 6,776,571 | B2 * | 8/2004 | Riffle | B66F 9/065 37/468 |
| 8,157,500 | B1 * | 4/2012 | Husmann | B66F 9/082 414/635 |
| 9,039,343 | B2 * | 5/2015 | Nishi | E02F 3/3417 414/698 |
| 2008/0232943 | A1 * | 9/2008 | Bruno | B66F 9/07518 414/635 |
| 2018/0072549 | A1 * | 3/2018 | Barnes | B66F 17/003 |

* cited by examiner

LOADING DEVICE OF FORKLIFT TRUCK

BACKGROUND OF THE INVENTION

The present invention relates to a loading device of a forklift truck and, particularly, to a loading device of a forklift truck, having a mast support shaft fixed to an outer mast by welding.

Japanese Patent Application Publication No. 2009-73618 discloses a mast device of a forklift truck. The mast device includes a pair of right and left outer masts that are connected with each other at positions adjacent to the top thereof by an upper stay that is disposed extending horizontally. A mast bracket having a shaft is welded to a rear wall of each outer mast. A lower beam is welded at the opposite ends thereof to the rear wall of the mast brackets. The lower beam enhances the rigidity of the mast device together with the upper stay and an intermediate stay. The shaft of the mast bracket is rotatably supported by the truck body at a front part thereof so that the mast device is pivotable back and forth on the shaft.

In the mast device of the above-disclosed structure and shown in FIG. 10, a mast support shaft 93 (corresponding to the shaft) is fixed by welding to a side plate 92 (corresponding to the mast bracket) that is fixed to an outer mast 91. The mast support shaft 93 includes a cylindrical shaft body 94 and a flange body portion 95 that is integrally formed with the shaft body 94. The flange body portion 95 is of a substantially cylindrical shape and coaxial with the axis of the shaft body 94. Numeral 96 designates a weld portion that is formed around the flange body portion 95 by welding to fix the mast support shaft 93 to the side plate 92. Since stress concentration occurs in the mast support shaft 93, the flange body portion 95 around which the weld portion 96 is formed needs to have a thickness that is large enough in the axial direction thereof to resist the stress concentration in the mast support shaft 93.

In the case that the mast support shaft is fixed on the outer side surface of the outer mast, however, the mast support shaft may be subject to design restrictions depending on dimensional conditions of the truck body and the outer mast that support the mast device. In such a case, the flange body cannot have enough thickness, so that the flange body cannot withstand the stress concentration in the weld portion between the mast support shaft and the outer mast.

The present invention which has been made in light of the problems mentioned above is directed to providing a loading device of a forklift truck which prevents stress concentration in the mast support shaft provided on the outer side surface of an outer mast.

SUMMARY OF THE INVENTION

In accordance with one aspect of the present invention, there is provided a loading device of a forklift truck, including a pair of right and left outer masts provided at a front part of a truck body, a pair of mast support shafts rotatably supported by the truck body, and a pair of weld portions formed by welding the respective mast support shafts to outer side surfaces of the outer masts along outer peripheries of the mast support shafts. Each weld portion is formed by weld bead. Each mast support shaft includes a shaft body that is rotatably supported by the truck body, a first flange portion that extends forward and upward from the shaft body and a second flange portion that extends rearward and downward from the shaft body. An outer periphery of the first flange portion is formed of a first curved surface that is continuously curved. An outer periphery of the second flange portion is formed of a second curved surface that is continuously curved. Each weld portion includes a first weld portion formed along the first curved surface of the first flange portion of the corresponding mast support shaft and a second weld portion formed along the second curved surface of the second flange portion of the corresponding mast support shaft.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF THE EMBODIMENTS

First Embodiment

Figure 1:
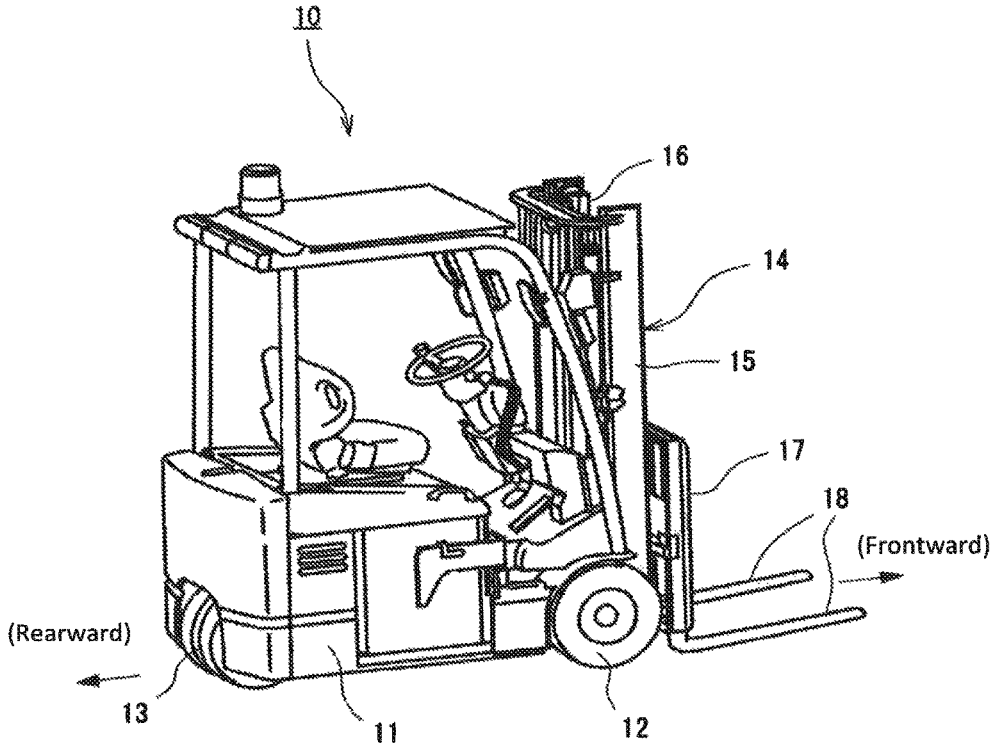
FIG. 1 is a perspective view of a forklift truck having a loading device according to a first embodiment of the present invention.

The following will describe a loading device of a forklift truck according to a first embodiment of the present invention with reference to FIG. 1 through FIG. 5. Referring to FIG. 1, the forklift truck that is generally designated by reference numeral 10 is a three-wheel forklift truck and includes a truck body 11. The truck body 11 includes a pair of front wheels 12 as driving wheels and a rear wheel 13 as a steerable wheel. The forklift truck 10 further includes a loading device 14 that is located at the front of the truck body 11.

The loading device 14 according to the first embodiment includes a pair of right and left outer masts 15 and a pair of inner masts 16 which are movable up and down relative to the respective outer masts 15. The forward and rearward directions of the forklift truck 10 are indicated by opposite direction arrows in FIG. 1. The inner masts 16 have a lift bracket 17 at the front of the loading device 14. The lift bracket 17 has a pair of right and left forks 18.

Figure 2:
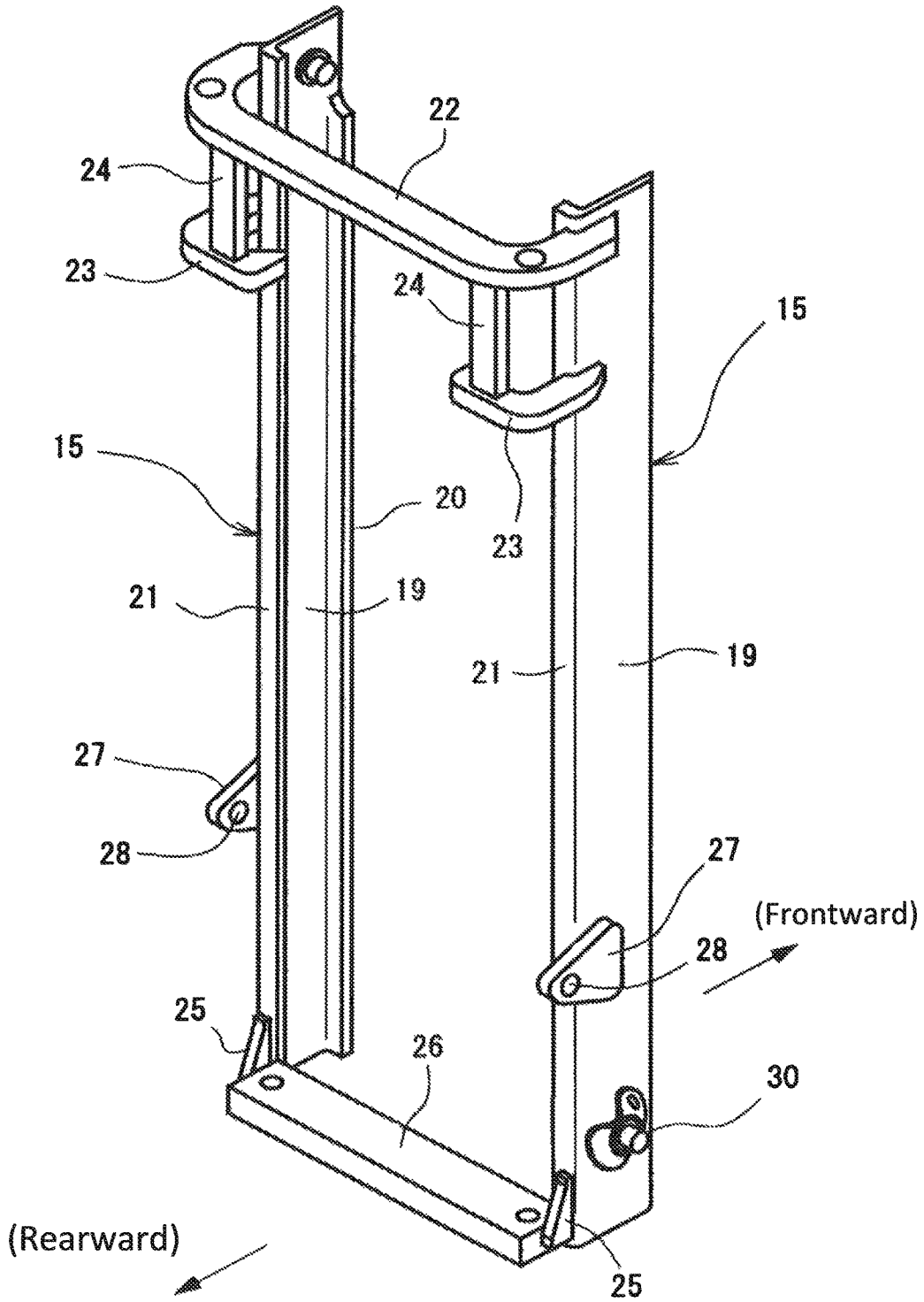
FIG. 2 is a perspective view of the loading device of the forklift truck of FIG. 1.

As shown in FIG. 2, the outer mast 15 is substantially U-shaped in transverse cross section. The forward and rearward directions of the loading device 14 are indicated by opposite direction arrows in FIG. 2. The outer mast 15 has a main wall portion 19, a front wall portion 20, and a rear wall portion 21. The main wall portion 19 has outer and inner surfaces extending substantially in parallel relation to the longitudinal direction of the forklift truck 10. The front wall portion 20 is provided at the front end of the main wall portion 19 and formed extending in perpendicular relation to the main wall portion 19. The front wall portion 20 has a front surface facing frontward and a rear surface facing rearward of the forklift truck 10. The rear wall portion 21 is provided at the rear end of the main wall portion 19 and formed extending in perpendicular relation to the main wall portion 19. The rear wall portion 21 has a front surface facing frontward and a rear surface facing rearward of the forklift truck 10. Edge between the outer surface of the main wall portion 19 and the rear surface of the rear wall portion 21 is chamfered into a curved surface.

The right and left outer masts 15 are connected to each other by an upper stay 22 that is horizontally disposed at positions adjacent to the top ends of the outer masts 15. The upper stay 22 is welded at the opposite ends thereof to the outer surfaces of the main wall portions 19 and the rear surfaces of the rear wall portions 21. The upper stay 22 is substantially U-shaped as viewed from the top of the loading device 14 so as to protrude rearward of the outer masts 15.

Chain anchors 23 are fixed to the outer masts 15 at positions spaced downward from the upper stay 22, respectively. The chain anchor 23 has a shape conforming to the end portion of the upper stay 22. A connecting member 24 is provided to connect the chain anchor 23 to the upper stay 22. Side plates 25 are welded to the rear surfaces of the respective rear wall portions 21 at positions adjacent to the bottom end of the outer masts 15. The side plate 25 extends rearward from the rear surface of the rear wall portion 21. A lower stay 26 is provided extending horizontally between the side plates 25 and the bottom ends of outer masts 15 are connected to the lower stay 26 through the side plates 25. The lower stay 26 and the upper stay 22 serve to enhance the rigidity of the loading device 14.

Figure 10:
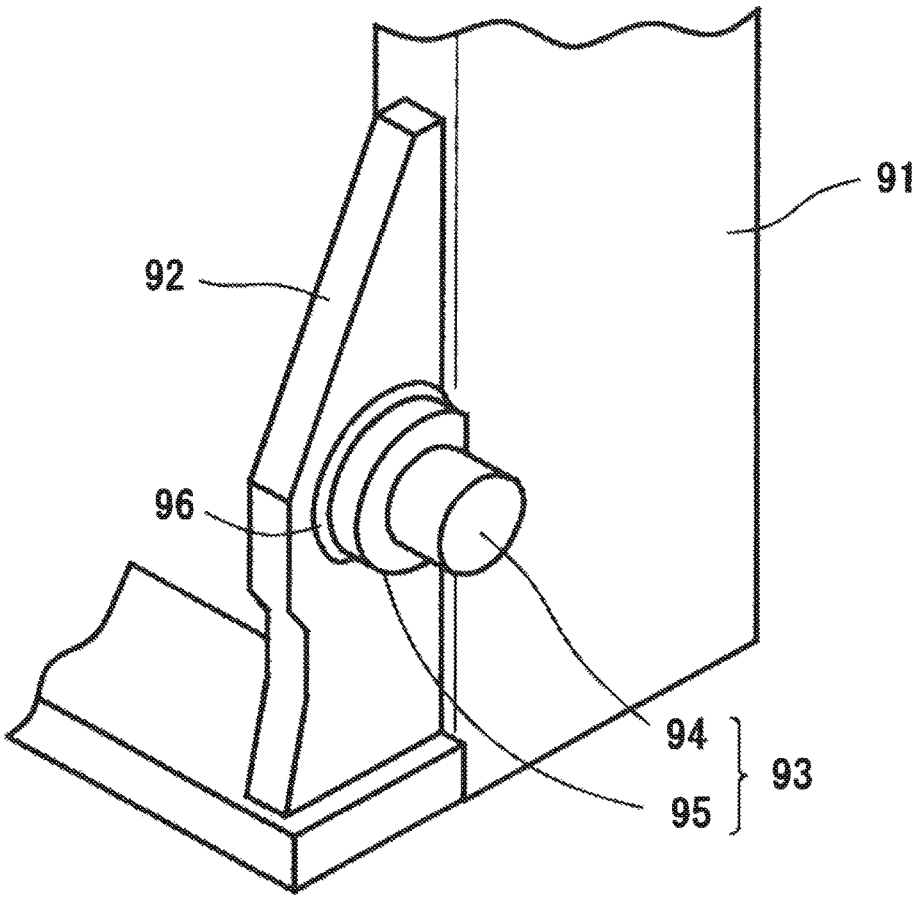
FIG. 10 (background art)
FIG. 10 is a perspective view of a mast support shaft of a loading device of a forklift truck according to the background art.

In the forklift truck of the first embodiment, the upper stay 22, the chain anchor 23, and the lower stay 26 have a thickness that is greater than that of the counterpart members of the forklift truck according to the background art. Accordingly, the side plate 25 is made smaller in size than the side plate 92 (FIG. 10) of the forklift truck according to the background art. The loading device 14 further includes a pair of lift cylinders (not shown in the drawing) extending upward from the lower stay 26. The lift cylinder has a piston rod whose end portion is fixed to an upper stay (not shown in the drawing) of the inner mast 16.

A tilt bracket 27 is welded to the outer side surface of each outer mast 15. The tilt bracket 27 is a metal plate whose opposite surfaces are uniformly flat. With the tilt bracket 27 fixed to the outer mast 15, the rear part of the tilt bracket 27 extends out from the outer mast 15. The tilt bracket 27 has therethrough a shaft hole 28 in the rear part thereof extending out from the outer mast 15. Each tilt bracket 27 supports at the shaft hole 28 thereof one end of a piston rod of a tilt cylinder (not shown in the drawing) that is pivotally mounted to the truck body 11.

Figure 3A:
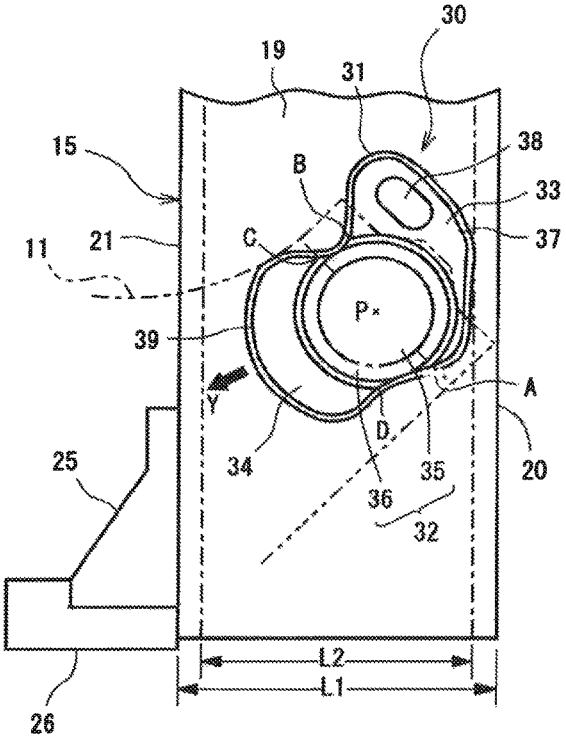
FIG. 3A is an enlarged fragmentary side view of the loading device of the forklift truck of FIG. 1.
Figure 3B:
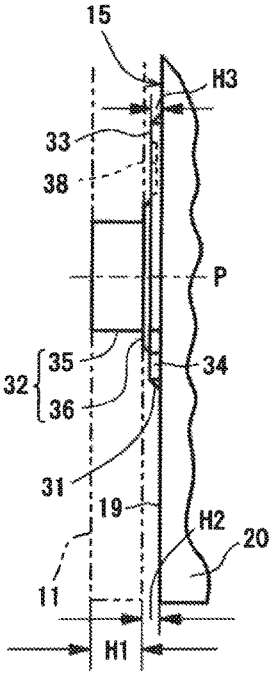
FIG. 3B is an enlarged fragmentary front view of the loading device of the forklift truck of FIG. 1.

Referring to FIG. 3A, a mast support shaft 30 is welded to the outer side surface of each main wall portion 19 at a position below the tilt bracket 27. Numeral 31 designates a weld portion 31 or weld bead formed around the mast support shaft 30. The outer masts 15 are pivotally supported by the mast support shafts 30 at the front part of the truck body 11 so that the loading device 14 is tiltable back and forth about the axis P of the mast support shaft 30. As shown in FIG. 3A, the mast support shaft 30 includes a shaft body 32. The shaft body 32 includes a first flange portion 33 and a second flange portion 34 that extend radially outward. Specifically, the first flange portion 33 extends frontward and upward from the shaft body 32, while the second flange portion 34 extends rearward and downward from the shaft body 32. The mast support shaft 30 according to the first embodiment is made by forging so that the shaft body 32, the first flange portion 33, and the second flange portion 34 are integrally formed. In FIG. 3A, L1 designates the width of the outer mast 15 as measured in the front and left direction, or in the longitudinal direction of the forklift truck 10, and L2 the width of flat surface of the outer mast 15 measured in the same direction, excepting the chamfered curved surface of the outer mast 15. Vertical front and rear edges of the outer mast 15 are chamfered into a curved surface. As shown in FIG. 3B, the contact surface in which the main wall portion 19 is connected to the mast support shaft 30 is a flat plane without any steps.

The cylindrical shaft body 32 is formed with its axis P extending horizontally and perpendicularly to the outer side surface of the main wall portion 19. The shaft body 32 includes a cylindrical pivot shaft 35 and a base 36 that is integrally formed with the pivot shaft 35 at the bottom thereof. The pivot shaft 35 is rotatably mounted to the truck body 11. The base 36 serves to ensure a space between the truck body 11 and the outer mast 15. The base 36 has a cylindrical clearance and is coaxial with the cylindrical pivot shaft 35. The outer diameter of the base 36 is greater than that of the pivot shaft 35. The axial length H1 of the pivot shaft 35 and the thickness H2 of the base 36 in the direction of the axis P of the pivot shaft 35 are set depending on the structure of the truck body 11.

The first flange portion 33 extends radially outwardly and forward and upward from the outer periphery of the base 36 of the shaft body 32. The thickness H3 of the first flange portion 33 as measured in the direction of the axis P is smaller than the thickness H2 of the base 36 (H2>H3). The shape of the first flange portion 33 was determined by the present inventors based on the result of analysis of the stress occurring around the mast support shaft 30 in the outer mast 15. After the stress analysis around the mast support shaft 30 in the outer mast 15, the inventors found that the stress concentration occurred in the mast support shaft 30 of the loading device 14 significantly in the arrow direction Y shown in FIG. 3A. Since the shaft body 32 is located closer to the front wall portion 20 than to the rear wall portion 21, the part of the first flange portion 33 extending in the direction opposite to the arrow direction Y is smaller, while the part of the same first flange portion 33 extending upward is relatively large. As a result, the first flange portion 33 is formed so that the stress of the weld portion 31 is dispersed and no excessive stress concentration occurs.

Figure 4:
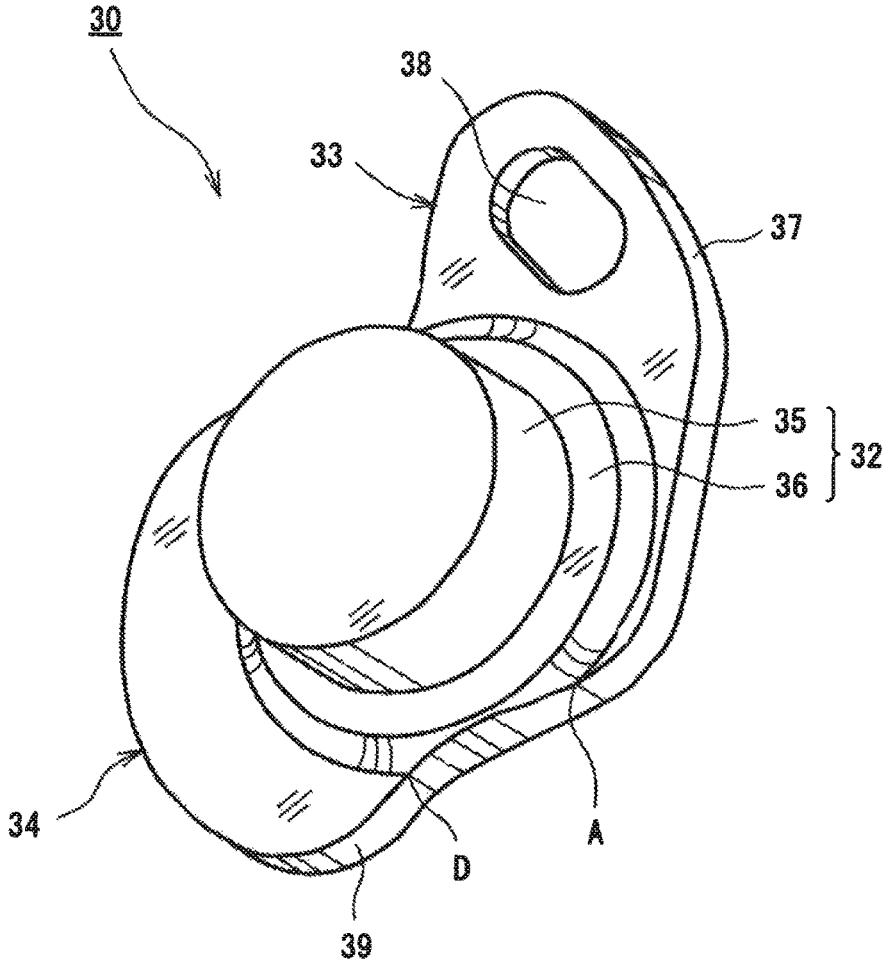
FIG. 4 is a perspective view of a mast support shaft of the loading device of FIG. 2.

In the first embodiment, the outer periphery of the first flange portion 33 is in contact with the circumference of the base 36 at two positions, namely the position A that is located downward of the axis P of the mast support shaft 30 and adjacent to the front wall portion 20 of the outer mast 15 and the position B that is located upward of the axis P in the outer periphery of the base 36 and is slightly rearward of the axis P. The outer periphery of the first flange portion 33 extends between the positions A and B. As shown in FIG. 4, the mast support shaft 30 has a first curved surface 37 and a second curved surface 39 that are continuously curved, respectively. The outer periphery of the first flange portion 33 forms the first curved surface 37. As shown in FIGS. 3 and 4, the first curved surface 37 is formed perpendicularly to the outer side surface of the main wall portion 19. The first flange portion 33 is formed within the flat outer side surface of the main wall portion 19, or rearward of the chamfered curved surface of the main wall portion 19.

The first flange portion 33 has therein an elongated bottomed hole 38 as a recess. The bottomed hole 38 that is recessed from the surface of the first flange portion 33 tends to cause stress to be concentrated around the bottomed hole 38. Such stress concentration around the bottomed hole 38 helps to reduce the stress applied to the weld portion 31. That is, the provision of the bottomed hole 38 in the first flange portion 33 alleviates the stress to the weld portion 31. The position, size, and depth of the bottomed hole 38 are determined based on the result of the analysis of stress occurring around the mast support shaft 30 in the outer mast 15 so that stress is not excessively concentrated in the weld portion 31.

The second flange portion 34 extends radially outwardly and rearward and downward from the outer periphery of the base 36 of the shaft body 32. The shaft body 32 is positioned relatively remote from the rear wall portion 21. The second flange portion 34 has a substantial crescent shape that extends in the arrow direction Y. The shape of the second flange portion 34 was determined by the present inventors based on the result of the analysis of the stress occurring around the mast support shaft 30 in the outer mast 15. The second flange portion 34 is formed so that the stress of the weld portion 31 is dispersed and no excessive stress concentration occurs. The thickness of the second flange portion 34 as measured in the direction of the axis P is substantially the same as the thickness H3 of the first flange portion 33.

In the first embodiment, the outer periphery of the second flange portion 34 is in contact with the circumstance of the base 36 at two positions, namely the position C that is located upward of and rearward of the axis P and slightly rearward of the position B of the first flange portion 33 and the position D that is located downward of the axis P and rearward of the position A of the first flange portion 33. The outer periphery of the second flange portion 34 extends between the positions C and D and forms the aforementioned second curved surface 39. As shown in FIGS. 3 and 4, the second curved surface 39 is formed perpendicularly to the outer side surface of the main wall portion 19. The second flange portion 34 is formed within the flat outer side surface of the main wall portion 19.

Figure 5:
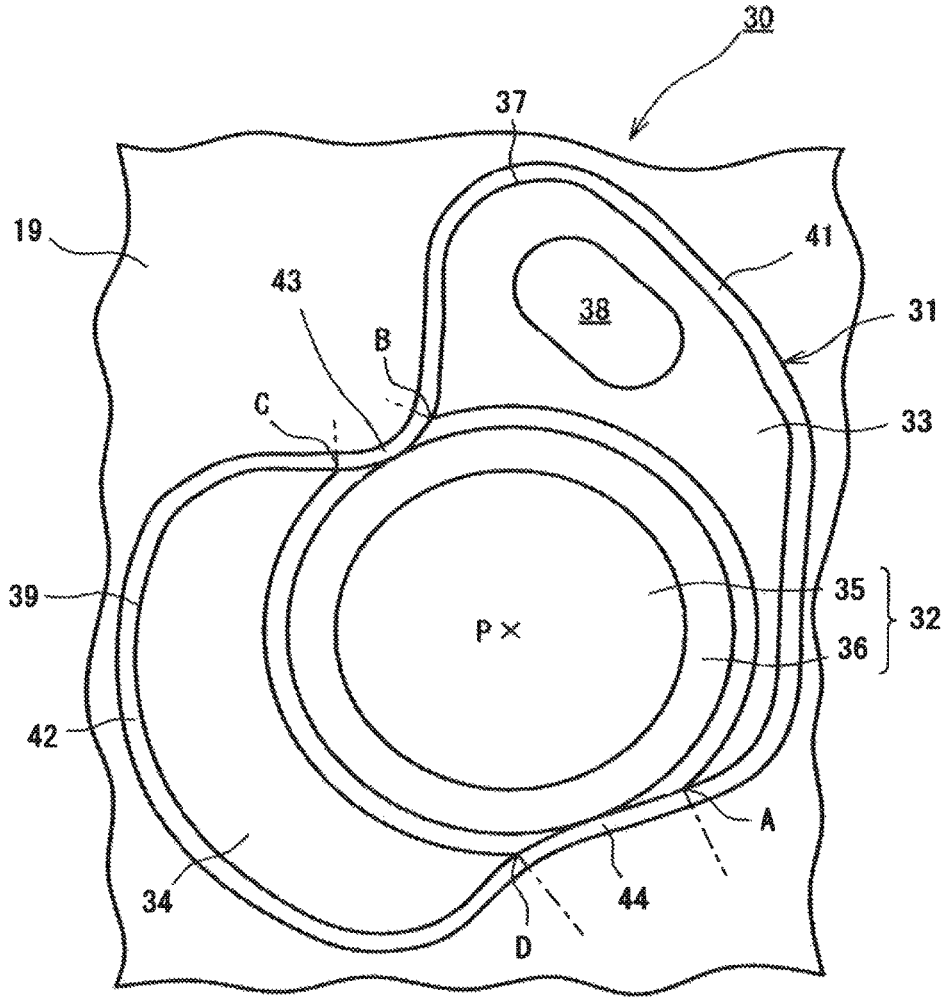
FIG. 5 is an enlarged side view showing a weld portion of the mast support shaft of FIG. 4.

The following will describe the weld portion 31 with reference to FIG. 5. The weld portion 31 includes a first weld portion 41 formed along the outer periphery of the first flange portion 33, a second weld portion 42 formed along the outer periphery of the second flange portion 34, a third weld portion 43 formed between one end of the first weld portion 41 and one end of the second weld portion 42 (or between the positions B and C) and a fourth weld portion 44 formed between the other end of the first weld portion 41 and the other end of the second weld portion 42 (or between the positions D and A). The third and fourth weld portions 43 and 44 are formed at part of the outer periphery of the base 36 as weld bead. The first, the second, the third, and the fourth weld portions 41 through 44 cooperate to form the weld portion 31 that is continuously formed along the outer periphery of the mast support shaft 30. It is noted that the boundaries between any two adjacent weld portions among the first, the second, the third, and the fourth weld portions 41 through 44 are indicated by the dashed lines, in FIG. 5.

The following will describe the operation of the loading device 14 according to the first embodiment. In the loading device 14 that is pivotally supported by the truck body 11 through the mast support shaft 30, the mast support shaft 30 receives the weight of the loading device 14 and of the load carried by the loading device 14. Then, stress corresponding to the weight is applied to the weld portion 31. The weld portion 31 that is continuously formed along the outer periphery of the mast support shaft 30 receives most of the stress. In the loading device 14, the stress is greatest in the arrow direction Y in FIG. 3A. The shapes of the first and the second flange portions 33 and 34 are determined so that the weld portion 31 receives the stress in the arrow direction Y. As a result, the weld portion 31 is formed so that the stress of the weld portion 31 is dispersed and no excessive stress concentration occurs.

As mentioned earlier, the bottomed hole 38 that is recessed from the surface of the first flange portion 33 tends to cause stress to be concentrated near the bottomed hole 38, with the result that the stress applied to the weld portion 31 is reduced by the stress concentrated around the bottomed hole 38.

The first embodiment of the present invention offers the following advantageous effects.

(1) The first flange portion 33 is formed extending frontward and upward from the shaft body 32 and the second flange portion 34 is formed extending rearward and downward from the shaft body 32. The first weld portion 41 formed along the outer periphery of the first curved surface 37 and the second weld portion 42 along the outer periphery of the second curved surface 39 cooperate to fix the mast support shaft 30 to the main wall portion 19 of the outer mast 15. The shapes of the first and the second flange portions 33, 34 are determined to be suitable for receiving the stress concentrated in the mast support shaft 30. The shapes of the first and the second weld portions 41, 42 are also determined to be suitable for receiving the stress concentrated in the mast support shaft 30 that pivotally supports the loading device 14. As a result, in the case that the mast support shaft 30 is subject to design restrictions such as dimensional conditions of the truck body 11 and the outer mast 15, the weld portion 31 that fixes the mast support shaft 30 and the outer mast 15 is prevented from the stress concentration.

(2) The provision of the bottomed hole 38 as a recess causes stress concentration to occur around the bottomed hole 38, with the result that the stress applied to the weld portion 31 is reduced by the stress that is concentrated near the bottomed hole 38.

(3) The first flange portion 33 of the mast support shaft 30 has therein the bottomed hole 38. The bottomed hole 38 may be easily provided by adding an operation to form a hole during the operation of forging the mast support shaft 30 to increase the strength.

(4) The first and the second flange portions 33, 34 to which the weld portion 31 is formed may be formed with a thickness that is smaller than the thickness of a circular flange according to the background art. In the case that the first and the second flange portions 33, 34 are formed with such a reduced thickness, the weld portion 31 can receive the stress successfully.

Second Embodiment

Figure 6:
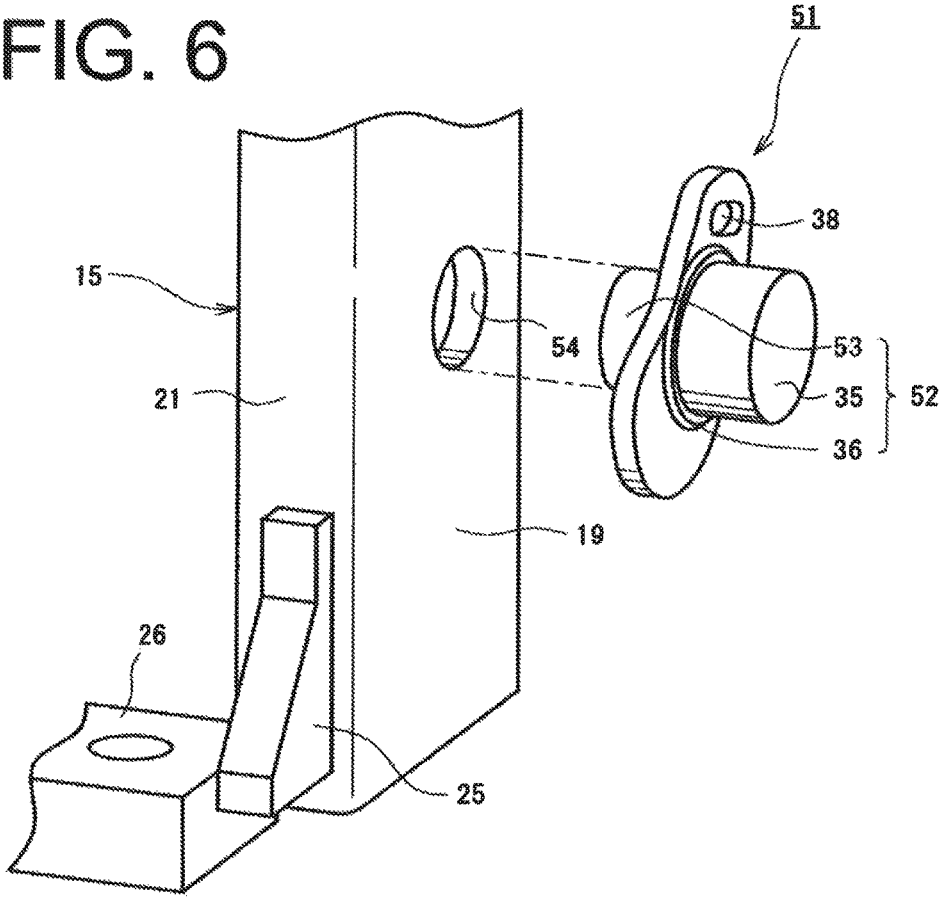
FIG. 6 is an enlarged exploded perspective view of a loading device of a forklift truck according to a second embodiment of the present invention.

The following will describe a loading device according to a second embodiment of the present invention with reference to FIG. 6. In the description of the second embodiment, same reference numerals are used for the common elements or components in the first embodiment, and the description of such elements or components for the second embodiment will be omitted. The second embodiment differs from the first embodiment in that the outer mast 15 has therethrough an insertion hole 54 and the shaft body 52 inserted in the insertion hole 54 and fixed to the outer mast 15 by welding.

Figure 7:
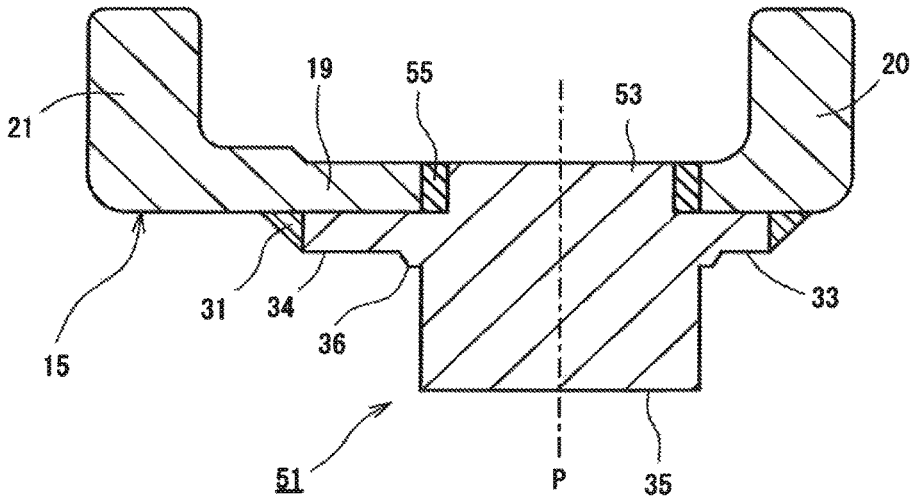
FIG. 7 is a transverse sectional view showing a weld portion of a mast support shaft of the loading device of FIG. 6.

Referring to FIG. 6, a shaft body 52 of a mast support shaft 51 includes the pivot shaft 35 that is rotatably mounted to the truck body 11, the base 36, and a pivot shaft 53 extending from the surface of the shaft body 52 opposite to the pivot shaft 35. The diameter of the pivot shaft 53 is smaller than that of the pivot shaft 35. The axial length of the pivot shaft 53 is smaller than that of the pivot shaft 35. The pivot shaft 53 corresponds to the insertion end of the present invention. The outer mast 15 according to the second embodiment has therethrough the insertion hole 54. The insertion hole 54 has such a diameter that allows the pivot shaft 53 to be inserted through the insertion hole 54. The mast support shaft 51 is fixed to the outer mast 15 by welding with the pivot shaft 53 inserted in the insertion hole 54 of the outer mast 15. As shown in FIG. 7, the weld portion 31 is formed along the entire outer periphery of the mast support shaft 51 on the outer surface of the outer mast 15. In the insertion hole 54, a hole weld portion 55 is formed between the pivot shaft 53 and the outer mast 15 by weld bead.

The second embodiment offers the same advantageous effects as the first embodiment. In the second embodiment in which the pivot shaft 53 is fixed to the outer mast 15 through the insertion hole 54 by the hole weld portion 55 in addition to the weld portion 31 formed along the outer periphery of the mast support shaft 51, the stress applied to the weld portion 31 between the mast support shaft 51 and the outer mast 15 is sufficiently reduced.

Third Embodiment

Figure 8A:
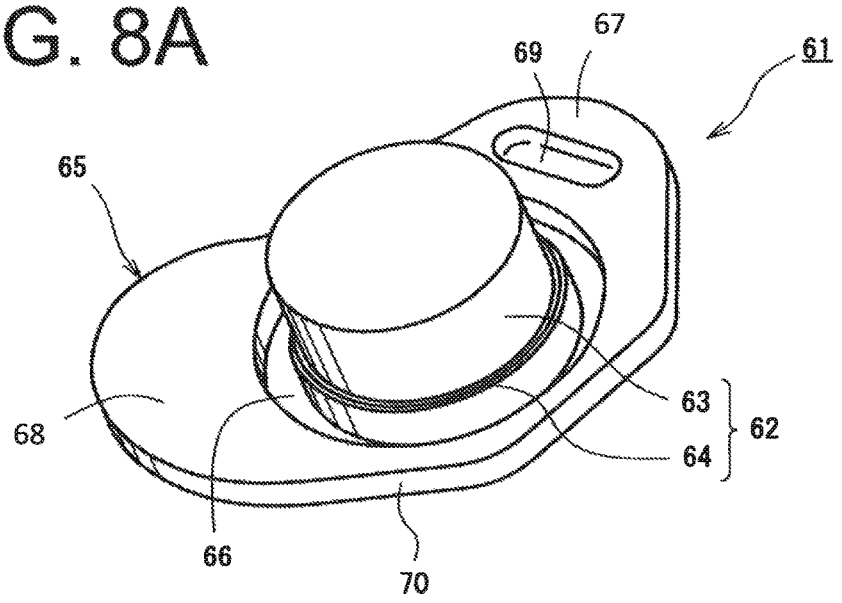
FIG. 8A is a perspective view of a mast support shaft of a loading device of a forklift truck according to a third embodiment of the present invention.
Figure 8B:
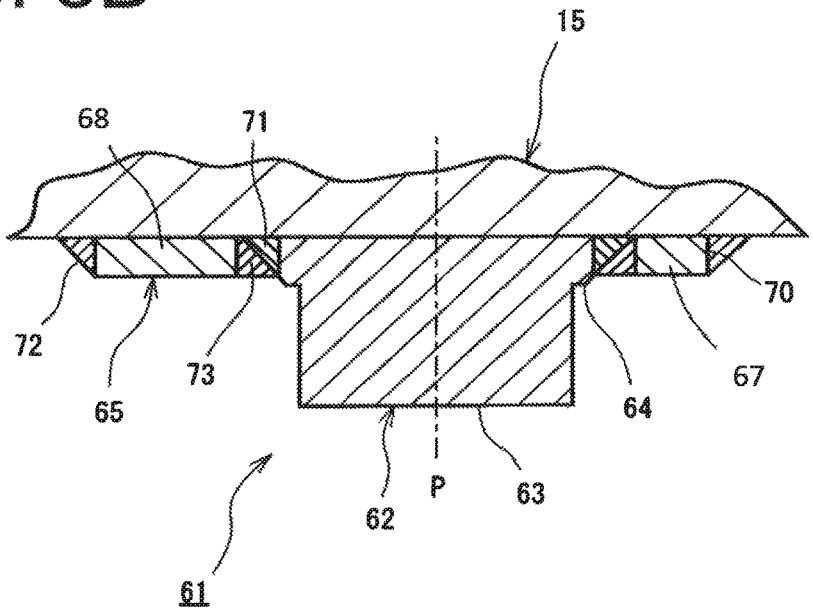
FIG. 8B is a transverse sectional view showing a weld portion of the mast support shaft of FIG. 8A.

The following will describe a loading device according to a third embodiment with reference to FIGS. 8A and 8B. In the description of the third embodiment, same reference numerals are used for the common elements or components in the first embodiment, and the description of such elements or components for the second embodiment will be omitted. The third embodiment differs from the first embodiment in that a mast support shaft 61 includes a shaft body 62 and the flange portion that is formed separately from the shaft body 62, and the shaft body 62 and the flange portion are separately welded to the outer mast.

Referring to FIG. 8A, the mast support shaft 61 includes the shaft body 62 including a pivot shaft 63 and a base 64, and a flange body 65 that is separately provided from the shaft body 62. The pivot shaft 63 substantially has the same configuration as the pivot shaft 35 of the first embodiment. The base 64 corresponds to the base 36 of the first embodiment. The flange body 65 is of a plate shape and has therethrough at the center thereof a circular insertion through hole 66. The insertion through hole 66 is greater in diameter than the shaft body 62.

The flange body 65 is formed of the first flange portion 67 and the second flange portion 68 that are integrally formed across the insertion through hole 66. The first flange portion 67 corresponds to the first flange portion 33 and the second flange portion 68 corresponds to the first flange portion 33 of the first embodiment, respectively.

The first flange portion 67 of the flange body 65 has therein a bottomed hole 69. The bottomed hole 69 has substantially the same configuration as the bottomed hole 38 of the first embodiment. The outer periphery of the flange body 65 is formed by a continuously curved surface 70 that is continuously curved. The curved surface 70 includes curved surfaces corresponding to the first curved surface 37 and the second curved surface 39 of the first embodiment.

According to the third embodiment, the shaft body 62 is fixed to the outer side surface of the outer mast 15 by welding and then the flange body 65 is welded to the outer side surface of the outer mast 15 with the shaft body 62 inserted through the insertion through hole 66. As shown in FIG. 8B, a shaft weld portion 71 is formed by the welding to fix the shaft body 62 to the outer mast 15. The flange body 65 is welded at the curved surface 70 thereof to the outer mast 15, so that an outer peripheral weld portion 72 is formed along the outer periphery of the flange body 65. Additionally, a hole weld portion 73 is formed by welding between the flange body 65 and the shaft weld portion 71. The outer peripheral weld portion 72 has the same function as the weld portion 29 according to the first embodiment. The hole weld portion 73 is formed overlapping with the shaft weld portion 71 in the axial direction of the shaft body 62. The shaft weld portion 71 and the hole weld portion 73 cooperate to fill the space between the shaft body 62 and the flange body 65.

The third embodiment offers the advantageous effects (1), (2) and (4) described with reference to the first embodiment. According to the third embodiment in which the mast support shaft 61 including the shaft body 62 and the flange body 65 that is formed separately from the shaft body 62 enables the mast support shaft 61 to be manufactured easily as compared to a mast support shaft that is formed integrally. The shaft weld portion 71 and the hole weld portion 73 filling the space between the shaft body 62 and the flange body 65 increase the number of weld portions to which stress is applied and, therefore, the mast support shaft 61 can withstand the stress.

The present invention may be practiced variously as exemplified below within the scope of the invention.

Figure 9A:
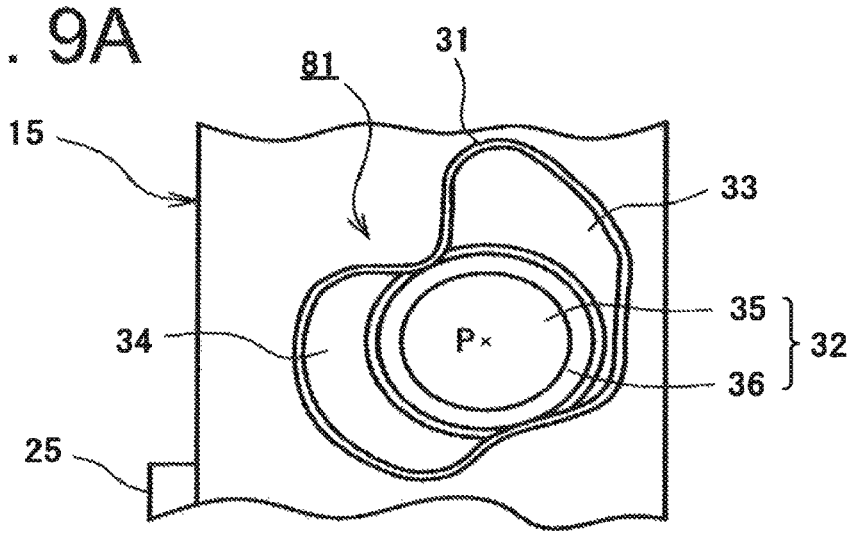
FIG. 9A is an enlarged side view of a loading device of a forklift truck according to another embodiment of the first embodiment.
Figure 9B:
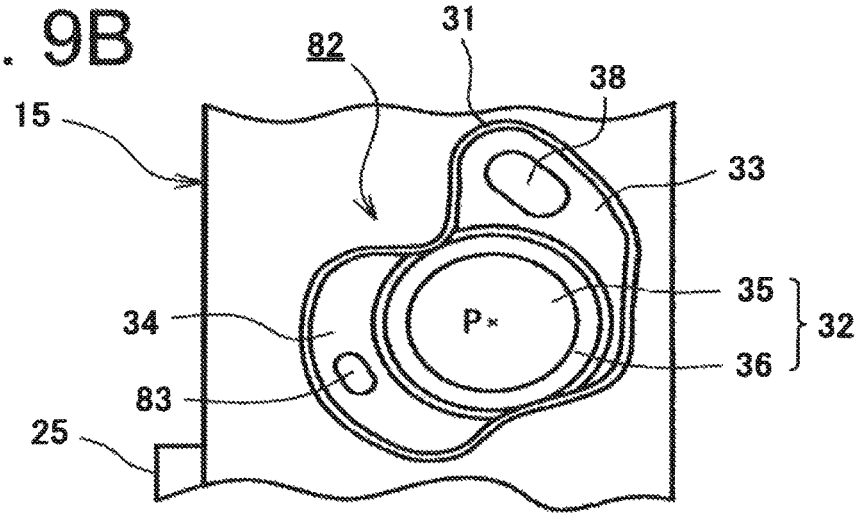
FIG. 9B is a view similar to FIG. 9A, but showing a loading device of a forklift truck according to still another embodiment of the first embodiment.

According to the first embodiment, the bottomed hole 38 as a recess is provided in the first flange portion 33. As shown in FIG. 9A, the mast support shaft 81 may be formed without a recess in the first flange portion 33. Similarly, in the mast support shaft according to the second and the third embodiments, the first flange portion may have no recess. As shown in FIG. 9B, the mast support shaft 82 may be provided to have a bottomed hole 83 in the second flange portion 34, as well as the bottomed hole 38 in the first flange portion 33. Alternatively, the mast support shaft may be so configured that the first flange portion 33 has therein no recess, while the second flange portion 34 has therein a recess.

According to the above-described embodiment, the bottomed hole is provided as a recess in the first flange portion, but a hole may be formed through the first flange portion. The same is true for the second flange portion. In case of providing a through hole through the flange portion, a weld portion is not provided at the through hole.

Figure 9C:
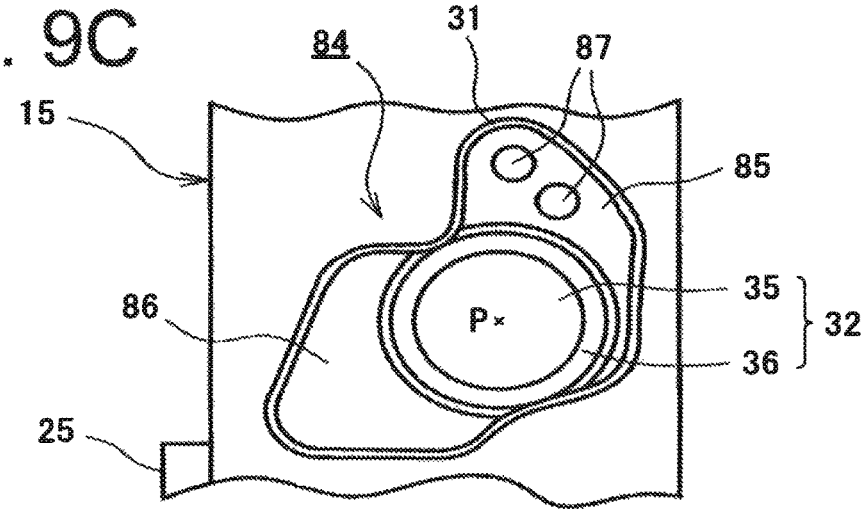
FIG. 9C is a view similar to FIG. 9A, but showing a loading device of a forklift truck according to yet another embodiment of the first embodiment.

According to the first embodiment, the shapes of the first flange portion and the second flange portion are preferably determined based on the result of the stress analysis. According to the present invention, however, the second flange portion 86 of the mast support shaft 84 may have a shape, for example, as shown in FIG. 9C, which is different from that of the second flange portion 34 according to the first embodiment. Furthermore, a plurality of circular bottomed holes 87 as a recess may be provided in the first flange portion 85. Additionally, the first flange portion 85 may have a shape that is different from that of the first flange portion 33 according to the first embodiment.

According to the above-described embodiment, the shape of the bottomed hole is elongated or oval-shaped, but the shape is not limited to such shape, provided that the shape has no corner. For example, the shape of a recess may be circular or ellipsoidal. The mast support shaft 84 shown in FIG. 9C may have a plurality of recesses in the first flange portion and/or the second flange portion.

According to the third embodiment, the shaft weld portion 71 and the hole weld portion 73 are overlapped with each other in the axial direction of the shaft body thereby to fill the space between the shaft body and the flange body. Alternatively, the space between the shaft body and the flange body may be filled by one-time welding.

What is claimed is:

1. A loading device of a forklift truck, comprising:

a pair of right and left outer masts provided at a front part of a truck body, each outer mast having a main wall portion;

a pair of inner masts;

a pair of mast support shafts rotatably supported by the truck body; and a pair of weld portions formed by welding the mast support shafts to outer side surfaces of the main wall portions of the outer masts along outer peripheries of the mast support shafts, respectively, each weld portion of the pair of weld portions being formed by weld bead;

wherein each mast support shaft includes a shaft body that is rotatably supported by the truck body, a first flange portion that extends forward and upward from the shaft body and a second flange portion that extends rearward and downward from the shaft body, wherein an outer periphery of the first flange portion is formed of a first curved surface that is continuously curved, wherein an outer periphery of the second flange portion is formed of a second curved surface that is continuously curved, and wherein the each weld portion of the pair of weld portions includes a first weld portion formed by welding the first flange portion along the first curved surface of the first flange portion of the corresponding mast support shaft to a respective outer side surface of the outer side surfaces of the main wall portions and a second weld portion formed by welding the second flange portion along the second curved surface of the second flange portion of the corresponding mast support shaft to the respective outer side surface of the outer side surfaces of the main wall portions.

2. The loading device of a forklift truck according to claim 1, wherein at least one of the first flange portion and the second flange portion includes a recess.

3. The loading device of a forklift truck according to claim 2, wherein the recess is provided in plurality.

4. The loading device of a forklift truck according to claim 2, wherein the recess is a bottomed hole or a through hole.

5. A loading device of a forklift truck, comprising:

a pair of right and left outer masts provided at a front part of a truck body, each outer mast having a main wall portion;

a pair of inner masts;

a pair of mast support shafts rotatably supported by the truck body; and a pair of weld portions formed by welding the mast support shafts to outer side surfaces of the main wall portions of the outer masts along outer peripheries of the mast support shafts, respectively, each weld portion being formed by weld bead;

wherein each mast support shaft includes a shaft body that is rotatably supported by the truck body, a first flange portion that extends forward and upward from the shaft body and a second flange portion that extends rearward and downward from the shaft body, wherein an outer periphery of the first flange portion is formed of a first curved surface that is continuously curved, wherein an outer periphery of the second flange portion is formed of a second curved surface that is continuously curved, wherein each weld portion includes a first weld portion formed along the first curved surface of the first flange portion of the corresponding mast support shaft and a second weld portion formed along the second curved surface of the second flange portion of the corresponding mast support shaft, wherein each outer mast has an insertion hole through which the corresponding shaft body is inserted, and wherein the shaft body has an insertion end that is inserted through the insertion hole and fixed to the outer mast by welding.

6. A loading device of a forklift truck, comprising:

a pair of right and left outer masts provided at a front part of a truck body, each outer mast having a main wall portion;

a pair of inner masts;

a pair of mast support shafts rotatably supported by the truck body; and a pair of weld portions formed by welding the mast support shafts to outer side surfaces of the main wall portions of the outer masts along outer peripheries of the mast support shafts, respectively, each weld portion being formed by weld bead;

wherein each mast support shaft includes a shaft body that is rotatably supported by the truck body, a first flange portion that extends forward and upward from the shaft body and a second flange portion that extends rearward and downward from the shaft body, wherein an outer periphery of the first flange portion is formed of a first curved surface that is continuously curved, wherein an outer periphery of the second flange portion is formed of a second curved surface that is continuously curved, wherein each weld portion includes a first weld portion formed along the first curved surface of the first flange portion of the corresponding mast support shaft and a second weld portion formed along the second curved surface of the second flange portion of the corresponding mast support shaft, wherein each mast support shaft has a flange body that is formed of the first flange portion and the second flange portion, wherein the shaft body is separately provided from the first flange portion and the second flange portion, wherein the flange body has an insertion through hole through which the shaft body is inserted, wherein a shaft weld portion is formed to fix the shaft body to the outer side surface of the outer mast, wherein a hole weld portion is formed along the insertion through hole, and wherein the shaft weld portion and the hole weld portion cooperate to fill a space between the flange body and the shaft body.

* * * * *